US007974567B2

(12) United States Patent
Park

(10) Patent No.: US 7,974,567 B2
(45) Date of Patent: Jul. 5, 2011

(54) IMAGE READING APPARATUS AND IMAGE FORMING APPARATUS INCLUDING THE SAME

(75) Inventor: Sang Cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 830 days.

(21) Appl. No.: 11/935,524

(22) Filed: Nov. 6, 2007

(65) Prior Publication Data

US 2008/0159793 A1 Jul. 3, 2008

(30) Foreign Application Priority Data

Dec. 28, 2006 (KR) ..... 10-2006-0136541

(51) Int. Cl.
*G03G 15/00* (2006.01)

(52) U.S. Cl. ..... 399/374; 399/367; 399/364; 355/23; 355/24

(58) Field of Classification Search ..... 399/374, 399/364; 271/303; 355/23, 24
See application file for complete search history.

(56) References Cited

U.S. PATENT DOCUMENTS 4,184,671 A * 1/1980 Sasamori ..... 271/18
5,296,908 A 3/1994 Hatano et al.
5,430,536 A 7/1995 Fullerton et al.
5,784,680 A * 7/1998 Taruki ..... 399/374
7,414,764 B2 * 8/2008 Shyu ..... 358/498

FOREIGN PATENT DOCUMENTS

CN 1779579 5/2006

OTHER PUBLICATIONS

Chinese Office Action issued Jul. 24, 2009 in CN 200710196322.8.

* cited by examiner

*Primary Examiner* — Matthew G Marini
(74) *Attorney, Agent, or Firm* — Stanzione & Kim, LLP

(57) ABSTRACT

An image reading apparatus and an image forming apparatus including the same to improve a transferring path of a document to prevent curl from being generated in the document and to prevent interference between a document having both surfaces scanned and a previously discharged document. The image reading apparatus includes a scan path having one end connected to a document supplying unit and the other end connected to a document discharging unit, a scan unit to read information recorded on a document passing through the scan path, a two-sided document branch path to branch from the scan path so that the document whose first surface is scanned by the scan unit passes through the two-sided document branch path before the document is reversed for a two-side scanning process, and a two-sided document transferring path having one end connected to the two-sided document branch path and other end connected to the scan path. A two-sided document guide is provided between the document supplying unit and the document discharging unit in a vertical direction to guide the document discharged from the two-sided document branch path.

18 Claims, 4 Drawing Sheets

IMAGE READING APPARATUS AND IMAGE FORMING APPARATUS INCLUDING THE SAME

CROSS-REFERENCE TO RELATED APPLICATIONS

This application claims the benefit of Korean Patent Application No. 2006-136541, filed on Dec. 28, 2006, in the Korean Intellectual Property Office, the disclosure of which is incorporated herein by reference in its entirety.

BACKGROUND OF THE INVENTION

1. Field of the Invention

The present invention relates generally to an image reading apparatus and an image forming apparatus including the same, and more particularly, to an image reading apparatus having a structure to scan both surfaces of a document and an image forming apparatus including the same.

2. Description of the Related Art

An image forming apparatus refers to an apparatus for printing an input image signal on a printing medium such as a printer, a copier, and a multifunction printer realized to combine functions of the printer and the copier. To be specific, the multifunction printer performs a function of printing image information input from an external apparatus such as a computer, a function of reading image information recorded in a document, a copy function of printing scanned and input image information, and a facsimile function of transmitting the scanned information to a remote place through a communication line.

A composite image forming apparatus includes an image reading apparatus to perform the above-described functions. A conventional image reading apparatus is disclosed in U.S. Pat. No. 5,430,536.

The disclosed image reading apparatus includes an input tray on which the document to be scanned is placed, an output tray on which the scanned document is placed, and a U-shaped document path formed between the input tray and the output tray. The image information recorded on one surface of the document that passes through a document path is scanned by a raster input scanner (RIS). Also, the disclosed conventional image reading apparatus includes a duplex document path connecting a lower side of the RIS to an upper side of the RIS on the document path in such a manner that two-sided scanning can be performed. Therefore, the document discharged to the output tray after one surface of the document has been scanned during the two-side scanning process is reversed at a specific point of time and passes through the duplex document path. The document that passes through the duplex document path passes through the document path again to completely scan one remaining surface.

However, in the conventional image reading apparatus, the duplex document path is severely inclined against the document path so that curl is generated in the document when the document passes through the duplex document path. When the curl is generated in the document, there is a high chance that the document is jammed in the image reading apparatus so that the reliability of the image reading apparatus deteriorates.

Furthermore, in the disclosed conventional image reading apparatus, when a great amount of documents is placed on the output tray, the document placed on the output tray and the document that is being scanned interfere with each other.

Therefore, both surfaces of the document are not smoothly scanned or the document placed on the output tray is also dragged when the document whose both surfaces are scanned is reversed to move.

SUMMARY OF THE INVENTION

The present general inventive concept provides an image reading apparatus in which a document path to prevent curl from being generated in a document and an image forming apparatus including the same.

The present general inventive concept provides an image reading apparatus to prevent interference between a document having both surfaces scanned and a previously delivered document and an image forming apparatus including the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image reading apparatus including a scan path having one end connected to a document supplying unit and the other end connected to a document discharging unit, a scan unit to read information recorded on a document passing through the scan path, a two-sided document branch path to branch from the scan path so that the document having a first surface scanned by the scan unit passes through the two-sided document branch path before the document is reversed for a two-side scanning process, and a two-sided document transferring path having one end connected to the two-sided document branch path and the other end connected to the scan path.

The image reading apparatus mat further include a two-sided document guide to guide the document discharged from the two-sided document branch path. The two-sided document guide may be provided between the document supplying unit and the document discharging unit in a vertical direction.

A first path converting apparatus may be provided at a region where the two-sided document branch path branches from the scan path so as to open the two-sided document branch path during the two-side scanning process.

A second path converting apparatus may be provided at a region where the two-sided document branch path meets the two-sided document transferring path so as to close the two-sided document branch path when the document is moved while being reversed on the two-sided document branch path.

The image reading apparatus may further include a reverse roller the reverse the document passing through the two-sided document branch path.

A part of the reverse roller may be positioned on the two-sided document branch path to transfer the document passing through the two-sided document branch path, and the other part of the reverse roller may be positioned on the scan path to discharge the document passing through the scan path.

The document discharging unit may include a loading surface inclined downward in a direction through which the document is discharged.

The foregoing and/or other aspects and utilities of the present general inventive concept may also be achieved by providing an image forming apparatus including an image reading apparatus including a main body formed with a document receiving port to receive a document to be scanned and a document discharging port to discharge the scanned document, a document transferring path provided in the main body, and a scan unit to read information recorded on the document, wherein the document transferring path includes a scan path including a first scan path formed at one end thereof with the document receiving port and a second scan path formed at one end thereof with the document discharging port, a two-sided document branch path to branch from the second scan path to extend to a two-sided document outlet formed between the document receiving port and the document discharging port, and a two-sided document transferring path to guide the document reversed on the two-sided document branch path to the first scan path.

The image forming apparatus may further include a two-sided document guide provided in the main body to guide the document discharged from the two-sided document outlet.

The second scan path may include first and second paths positioned upstream and downstream portions, respectively, on a basis of a point at which the two-sided document branch path branches from the second scan path, and the image forming apparatus may include a first path converting unit to convert a path to selectively connect the first path to one of the second path and the two-sided document branch path.

The image forming apparatus may further include a second path converting unit to close the two-sided document branch path and to open the two-sided document transferring path when the document is reversed on the two-sided document branch path to be transferred.

The image forming apparatus may further include a roller provided between the two-sided document branch path and the second scan path to transfer the document passing through the two-sided document branch path and to discharge the document passing through the second scan path.

The foregoing and/or other aspects and utilities of the present general inventive concept may also be achieved by providing an image reading apparatus including a main body having a document receiving port, a document discharging port, and a two-sided document outlet disposed between the document receiving port and the document discharging port, a scan unit disposed between a first scan path connected to the document receiving port and a second scan path connected to the document discharging port to read information of a document passing from the first scan path to the second scan path, and a two-sided document branch path connected between the second scan path and the two-sided document outlet to receive the document from the second scan path and to feed back the document toward the first scan path through the two-sided document outlet.

The two-sided document branch path may be connected to the first scan path

The image reading apparatus may further include a two-sided document transferring path connected between the two sided document branch path and the first scan path to transfer the document from the two sided document ranch path and the two-sided document outlet toward the first scan path.

The main body may include a side disposed in a vertical direction; and the document receiving port, a document discharging port, and a two-sided document outlet may be disposed on the side of the main body.

The first scan path may receive the document from an outside of the main body through the document receiving port in a first direction, the second path may discharge the document to the outside of the main body through the document discharging port in a second direction, and the two-sided document branch path may expose the document received from the second scan path to the outside of the main body through the two-sided document outlet in a third direction and feeds back to the first scan path.

At least two of the first direction, the second direction, and the third direction may be a same direction, and one of the first direction, the second direction, and the third direction may be a different direction from the same direction.

The main body may include a side disposed in a vertical direction, and the first direction, the second direction, and the third direction may have a first angle, a second angle, and a third angle with respect to the vertical direction, respectively.

The foregoing and/or other aspects and utilities of the present general inventive concept may also be achieved by providing an image forming apparatus including a printing unit to print an image on a printing medium, and a cover to cover a surface of the printing unit, and comprising an image reading unit having a main body having a document receiving port, a document discharging port, and a two-sided document outlet disposed between the document receiving port and the document discharging port, a scan unit disposed between a first scan path connected to the document receiving port and a second scan path connected to the document discharging port to read information of a document passing from the first scan path to the second scan path, and a two-sided document branch path connected between the second scan path and the two-sided document outlet to receive the document from the second scan path and to feed back the document toward the first scan path through the two-sided document outlet.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
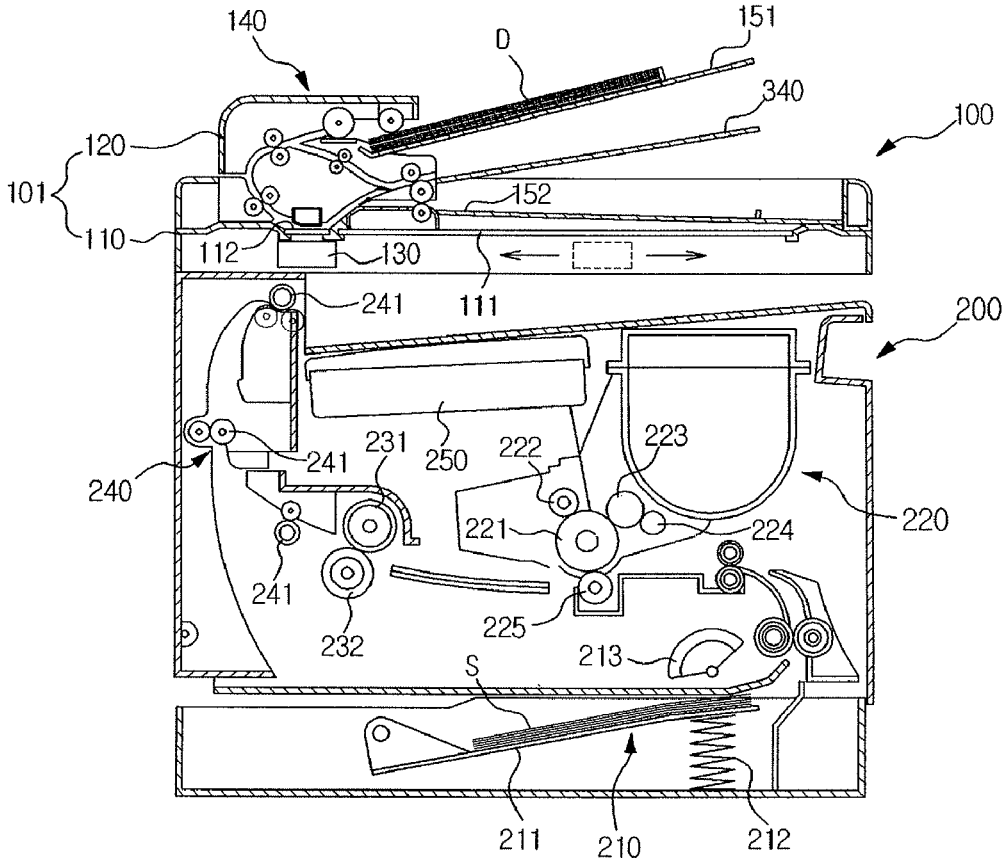
FIG. 1 illustrates an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
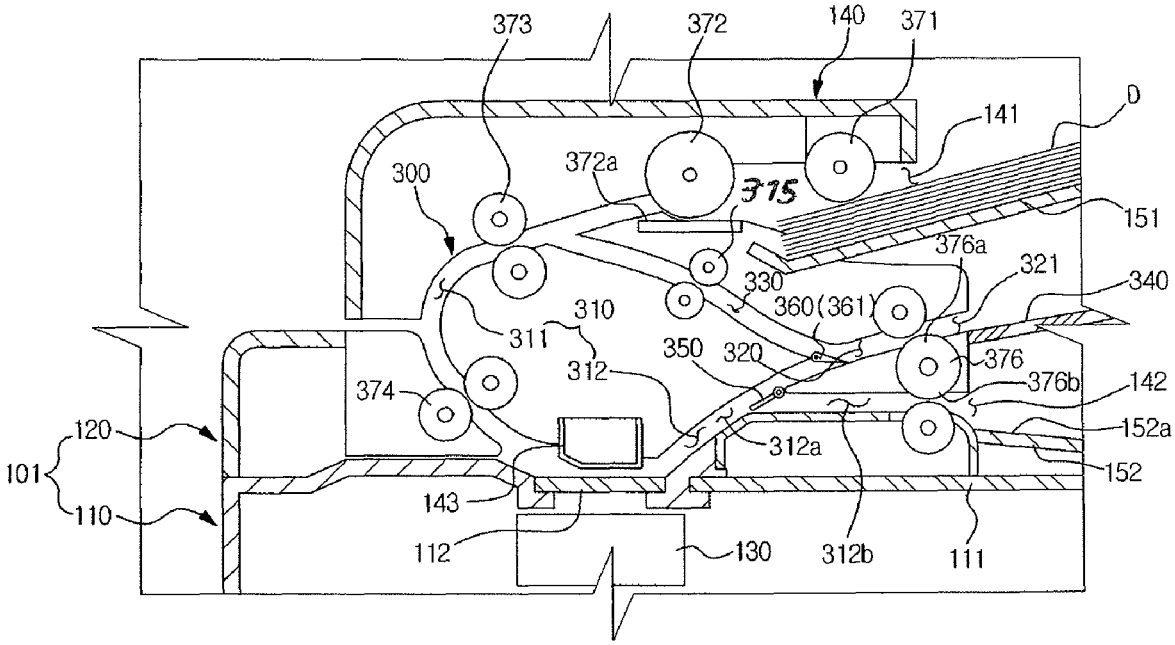
FIG. 2 illustrates a partial structure of the image forming apparatus of FIG. 1.

FIG. 1 illustrates an image forming apparatus according to an embodiment of the present general inventive concept. FIG. 2 illustrates a partial structure of the image forming apparatus of FIG. 1.

As illustrated in FIG. 1, the image forming apparatus according to the present embodiment includes an image reading apparatus 100 to read an image recorded on a document and a printing apparatus 200 to print the image on a sheet.

The printing apparatus 200 may print the image according to image information, i.e., a signal input from the image reading apparatus 100 as the read image, and a signal input from an external apparatus, such as a personal computer (PC). The printing apparatus 200 includes a sheet feeding unit 210 to supply a sheet (S) that is a printing medium, a developing unit 220 to develop the image on the sheet, a fixing unit 230 to apply heat and pressure to the sheet to fix the developed image to the sheet, and a sheet discharging unit 240 to discharge the sheet on which printing is performed to an outside thereof.

The sheet feeding unit 210 includes a sheet tray 211 on which the sheets (S) are accumulated and a spring 212 to elastically support the sheet tray 211. The sheets accumulated on the sheet tray 211 are picked up one by one using a pick up roller 213 and are moved toward the developing unit 220.

The developing unit 220 includes a photosensitive drum 221 having a surface formed with an electrostatic latent image by a laser scan unit 250, a charging roller 222 to charge the photosensitive drum 221, a developing roller 223 to develop the electrostatic latent image formed in the photosensitive drum 221 with a toner to form a toner image, a supplying roller 224 to supply the toner to the developing roller 223, and a transferring roller 225 to press the sheet toward the photosensitive drum 221 such that the toner image developed on the photosensitive drum 221 is transferred to the sheet.

The fixing unit 230 includes a heating roller 231 having a heat source to apply heat to the toner image transferred to the sheet and a pressing roller 232 provided to face the heating roller 231 to maintain uniform fixing pressure between the heating roller 231 and the pressing roller 232.

The sheet discharging unit 240 includes a series of sheet discharging rollers 241 sequentially provided to discharge the sheets that pass through the fixing unit 230 to the outside.

As illustrated in FIGS. 1 and 2, the image reading apparatus 100 includes a reading apparatus main body 101 composed of a scanning frame 110 and a cover 120. The cover 120 is rotatably coupled to the scanning frame 110 to open and close a top surface of the scanning frame 110.

A scan unit 130 to read information recorded on the document is provided in the scanning frame 110, and an automatic document supplying unit 140 is provided in the cover 120 so as to automatically supply the document such that continuous scanning can be performed.

A flat plate glass 111 and an automatic document feeding (ADF) glass 112 are provided on the top surface of the scanning frame 110. A user places the document on the flat plate glass 111 one by one to scan the document. The ADF glass 112 scans the document transferred by the automatic document supplying unit 140. The scan unit 130 is provided under the flat plate glass 111 and the ADF glass 112 to read image information recorded on the document placed on the flat plate glass 111 and on the document transferred by the automatic document supplying unit 140. The scan unit 130 radiates light onto the document to detect the light reflected from the document and converts the amount of the detected light into an electrical signal to read information or image from the document as the image information. A constant image sensor (CIS) or a charge coupled device (CCD) can be used as the scan unit 130.

As illustrated in FIG. 2, the automatic document supplying unit 140 includes a document receiving port 141 to which the document to be scanned is received, a document discharging port 142 from which the scanned document is discharged, a document transferring path 300 formed in the cover 120 in order to transfer the document, and rollers provided on the document transferring path 300 to transfer the document.

The document receiving port 141 is formed on one side of the cover 120 and the document discharging port 142 is formed below the document receiving port 141. A document supplying unit 151, on which the document D to be transferred by the automatic document supplying unit 140 is placed, is provided adjacent to the document receiving port 141. A document discharging unit 152 on which the scanned and discharged document is placed is provided adjacent to the document discharging port 142. The document discharging unit 152 may have a loading surface 152*a* inclined downward in the direction through which the document is discharged in order to make a space on the document discharging unit 152 as large as possible considering that the space on the document discharging unit 152 is reduced by a two-sided document guide 340 to be mentioned later so that it may be inconvenient for the user to pull or pick the document out of the document discharging unit 152.

The document transferring path 300 includes a scan path 310 one end of which is connected to the document supplying unit 151 through the document receiving port 141 and the other end of which is connected to the document discharging unit 152 through the document discharging port 142. The scan path 310 may be C-shaped as illustrated in FIG. 2, for example. The ADF glass 112 is provided on the scan path 310 so that the scan unit 130 can read the image information recorded on the document that passes through the scan path 310. A white bar 143 is provided on the ADF glass 112 to press the document so that the document is attached to the ADF glass 112. Hereinafter, the scan path 310 provided in an upper part is referred to a first scan path 311 and the scan path provided in a lower part is referred to as a second scan path 312 based on the point of time where the document is scanned on the scan path 310, for example, with respect to a location of the scanning unit 130 on the scan path 310.

Also, the document transferring path 300 includes a two-sided document branch path 320 that branches from the second scan path 312 and a two-sided document transferring path 330 one end of which is connected to the two-sided document branch path 320 and the other end of which is connected to the first scan path 311. When it is necessary to divide the second scan path 312 based on the point at which the two-sided document branch path 320 branches, the second scan path 312 positioned in an upper part thereof is referred to as a first sub-path 312*a* and the second scan path 312 positioned in a lower part thereof is referred to as a second sub-path 312*b* based on the branch point.

The two-sided document branch path 320 and the two-sided document transferring path 330 transfer the document, a first surface of which has been scanned by the scan unit 130, toward the upper part of the scan unit 130, so that the remaining second surface of the document is scanned when it required to scan both surfaces of the document. During the scanning of both surfaces of the document, the document that passes through the two-sided document branch path 320 changes a movement direction at a specific point of time to enter the two-sided document transferring path 330.

The two-sided document branch path 320 is extended from the cover 120 to a two-sided document outlet 321 formed between the document receiving port 141 and the document discharging port 142. The two-sided document guide 340 guiding the document discharged through the two-sided document outlet 321 is provided between the document supplying unit 151 and the document discharging unit 152 in a vertical direction. The two-sided document guide 340 supports the document when the document is discharged to the outside of the cover 120 before the document is reversed in the two-sided document branch path 320 to prevent the document from hanging or falling down from the two-sided document outlet 321.

According to the present embodiment, it is possible to make the path along which the document circulates slowly inclined during the scanning of both surfaces of the document using the two-sided document branch path 320 that branches from the scan path 310 so as to prevent curl from being generated in the document. Furthermore, since the document that passes through the two-sided document branch path 320 is discharged through the two-sided document outlet 321, which is formed separately from the document discharging port 142, and then is reversed, the document with both surfaces scanned does not interfere with the document placed on the document discharging unit 152.

A first path converting unit 350 is provided at a point where the two-sided document branch path 320 branches from the scan path 310, and a second path converting unit 360 is provided at a point where the two-sided document branch path 320 and the two-sided document transferring path 330 meet each other.

During the single-sided scanning in which only the first surface of the document is scanned and the document is discharged, the first path converting unit 350 connects the first sub-path 312*a* and the second sub-path 312*b* to each other. During the two-side scanning process in which both surfaces of the document are scanned, the first path converting unit 350 connects the first path 312*a* and the two-sided document branch path 320 to each other. The second path converting unit 360 closes the two-sided document branch path 320 from the first sub-path 312*a* when the document is reversed on the two-sided document branch path 320 and is transferred, and opens the two-sided document transferring path 330 from the two-sided document branch path 320. An opening and closing member 361 one end of which is hinged to be maintained to rotate downward by an empty weight so that the two-sided document transferring path 330 is always opened from the two-sided document branch path 320, and rotates upward by a transferring force of the document to open the two-sided document branch path 320 from the first sub-path 312*a* when the document is transferred through the two-sided document branch path 320 can be used as the second path converting unit 360.

Rollers transferring the document include a document pickup roller 371 to pick up the document placed on the document supplying unit 151, first to third transferring rollers 372, 373, and 374 to transfer the document picked up by the document pickup roller 371 on the scan path 310, a two-sided document transferring roller 375 provided on the two-sided document transferring path 330 to transfer the document to the first scan path 311 in order to scan the second surface, and a reverse roller 376 to reverse the document that passes through the two-sided document branch path 320. Among the transferring rollers, the first transferring roller 372 is disposed closest to the document pickup roller 371 to separate one or more documents picked up by the document pickup roller 371 one by one. Therefore, a friction pad 372*a* is provided to face the first transferring roller 372.

The reverse roller 376 is provided between the two-sided document branch path 320 and the second scan path 312. A part 376*a* of the reverse roller 376 is provided on the two-sided document branch path 320 to transfer the document on the two-sided document branch path 320 in the direction where the document is discharged to the two-sided document outlet 321 and to reverse at a specific point where the document is transferred to the two-sided document transferring path 330 from the two-sided document branch path 320. The other part 376*b* of the reverse roller 376 is provided on the second sub-path 312*b* to discharge the scanned document to the document discharging unit 152. That is, the reverse roller 376 also performs the function of a discharging roller to discharge the document to the document discharging unit 152.

The two-sided document branch path 320 is disposed between the second sub-path 312*b* and a portion of the first scan path 311 of the scan path 310 corresponding to the document receiving port 141 to receive the document from the first sub-path 312*a* and to feed the document back to the first scan path 311 through the two-sided document transferring path 330.

Figure 3:
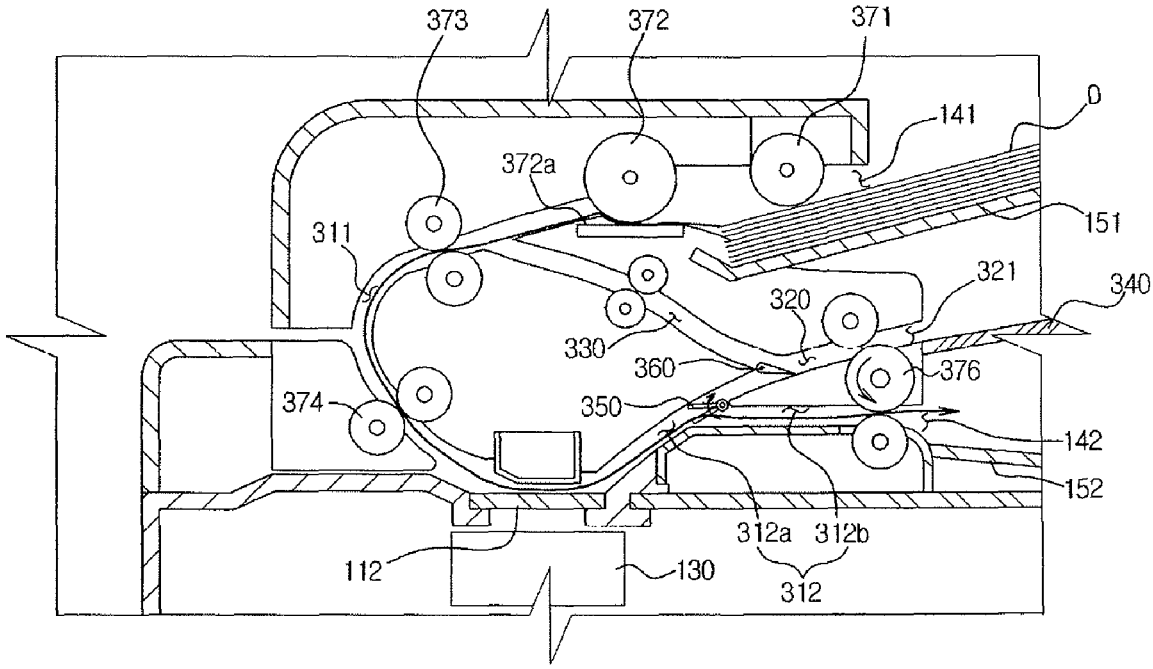
FIGS. 3 and 4 illustrate operations of an image reading apparatus in the image forming apparatus of FIG. 1 according to an embodiment of the present general inventive concept.
Figure 4:
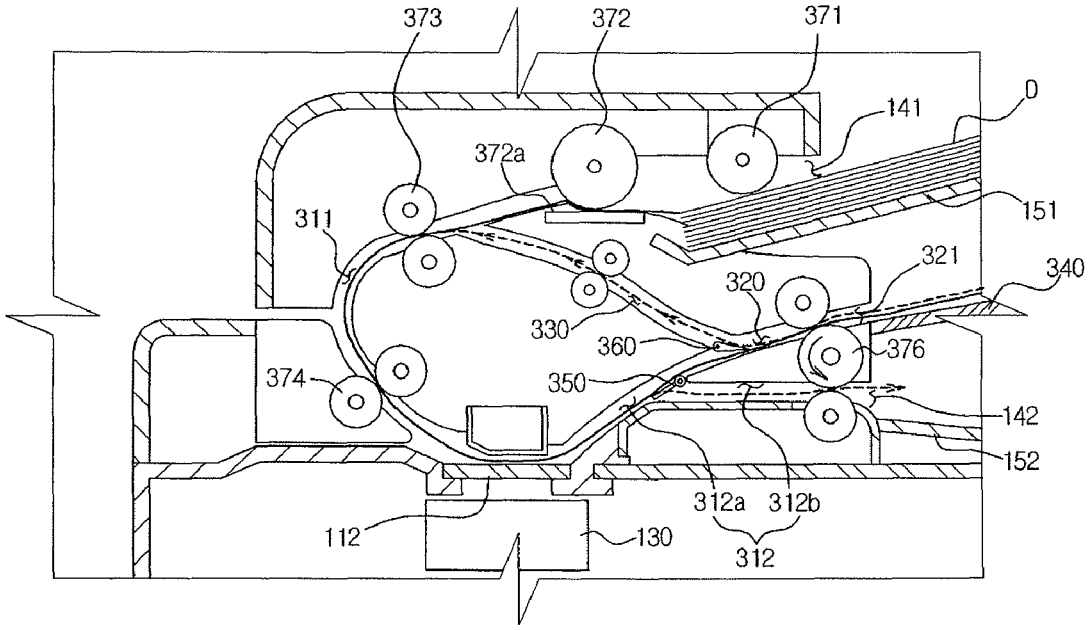

Hereinafter, the operations of the image reading apparatus and the image forming apparatus according to an embodiment of the present general inventive concept will be described with reference to FIGS. 1 through 4. FIG. 3 illustrates a single-sided scanning process of the image reading apparatus of FIGS. 1 and 2. FIG. 4 illustrates a two-side scanning process of the image reading apparatus of FIGS. 1 and 2. The single-sided scanning process may be referred to as a simplex scanning process, and the two-sided scanning process may be referred to as a duplex scanning process.

First, the single-sided scanning process in which only the first surface of the document is scanned will be described with reference to FIG. 3. When the single-sided scanning process starts, the one or more documents D placed on the document supplying unit 151 can be picked up by the document pickup roller 371 and the picked up documents are divided into pieces, that is, are separated one by one while passing between the first transferring roller 372 and the friction pad 372*a* to be transferred along the first scan path 311 by the second transferring roller 373 and the third transferring roller 374. When the transferred document passes on the ADF glass 112, the scan unit 130 positioned under the ADF glass 112 reads the image information recorded on the first surface of the document. The scanned document is transferred along the second scan path 312. At this time, the first path converting unit 350 closes the two-sided document branch path 320 from the first sub-path 312*a* and connects the first path 312*a* and the second path 312*b* to each other so that the document is transferred toward the document discharging port 142. The document transferred toward the document discharging port 142 is discharged to the document discharging unit 152 by the reverse roller 376 that rotates in a counterclockwise direction.

The two-side scanning process in which both surfaces of the document are scanned will be described with reference to FIG. 4. When the two-side scanning process starts, the document D placed on the document supplying unit 151 is transferred by the pickup roller 371 and the first to third transferring rollers 372, 373, and 374. When the document passes on the ADF glass 112, the first surface of the document is scanned by the scan unit 130.

The document having the scanned first surface is transferred along the second scan path 312. At this time, the first path converting unit 350 closes the second sub-path 312*b* and connects the first sub-path 312*a* and the two-sided document branch path 320 to each other so that the document enters the two-sided document branch path 320. The document that enters the two-sided document branch path 320 lifts the second path converting unit 360 that rotates downward by the empty weight to move toward the reverse roller 376. At this time, the reverse roller 376 rotates in the clockwise direction for a predetermined time so that the leading end of the document passes through the two-sided document outlet 321 to be discharged to the two-sided document guide 340. After a trailing end of the document passes through the second path converting unit 360, at a specific point of time, the reverse roller 376 changes a direction of rotation to rotate in the counterclockwise direction. Then, the transferring direction of the document is reversed so that the document is guided to the two-sided document transferring path 330 and that the document passes through the two-sided document transferring path 330 to be received to the first scan path 311. Therefore, the document passes through the scan unit 130 again so that the second surface of the document is scanned. The document with both surfaces scanned passes through the second path 312*b* of the second scan path 312 to be discharged to the document discharging unit 152 by the reverse roller 376 like in the single-sided scanning.

When a command for printing the image information is generated or a printing command is generated from an external computer, the printing sheet S placed on the sheet tray 211 is picked up by the pickup roller 213 to move along a determined path. The sheet sequentially passes through the developing unit 220 and the fixing unit 230 so that the image is printed on the printing sheet. The sheet that passes through the fixing unit 230 is discharged outside by the sheet discharging rollers 241.

As described above, according to the present general inventive concept, during the two-side scanning process, the path through which the document is transferred is slowly inclined so that it is possible to prevent curl from being generated during the two-side scanning process. Therefore, the possibility of the document being jammed in the image reading apparatus to damage the document is significantly reduced so that the reliability of the apparatus improves.

Also, according to the present general inventive concept, since the document with both surfaces being scanned does not interfere with the document placed on the document discharging unit, the two-side scanning process is readily performed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image reading apparatus comprising:

a main body having a document receiving port and a document discharging port;

a scan path having one end connected to the document receiving port and the other end connected to the document discharging port;

a scan unit to read information recorded on a document passing through the scan path;

a two-sided document branch path to branch from the scan path to receive the document having a first surface scanned by the scan unit before the document is reversed for a two-side scanning process;

a two-sided document transferring path having one end connected to the two-sided document branch path and the other end connected to the scan path; and a first path converting apparatus provided in the two-sided document branch path at a region where the two-sided document branch path meets the two-sided document transferring path, wherein the two-sided document branch path includes a first portion between the scan path and the two-sided document transferring path, and a second portion between the two-sided document transferring path and a two-sided document outlet to an outside of the main body, and the first path converting apparatus is rotatable about a hinge and weighted to maintain open a document travel path between the two-sided document branch path and the two-sided document transferring path and to rotate upward when a document presses against a surface of the first path converting apparatus to allow the document to pass from the first portion of the two-sided document branch path to the second portion of the two-sided document branch path.

2. The image reading apparatus of claim 1, further comprising:

a two-sided document guide to guide the document discharged from the two-sided document branch path.

3. The image reading apparatus of claim 2, wherein the two-sided document guide is provided between a document supplying unit adjacent to the document receiving port and a document discharging unit adjacent to the document discharge port, in a vertical direction.

4. The image reading apparatus of claim 1, further comprising:

a second path converting apparatus provided at a region where the two-sided document branch path branches from the scan path so as to open the two-sided document branch path during the two-side scanning process.

5. The image reading apparatus of claim 1, further comprising:

a reverse roller to reverse the document passing through the two-sided document branch path.

6. The image reading apparatus of claim 5, wherein the reverse roller comprises a part positioned on the two-sided document branch path to transfer the document passing through the two-sided document branch path, and the other part positioned on the scan path to discharge the document passing through the scan path.

7. The image reading apparatus of claim 1, further comprising a document discharging unit adjacent to the document discharging port, the document discharging unit having a loading surface inclined downward in a direction through which the document is discharged.

8. An image forming apparatus comprising:

an image reading apparatus including a main body in which a document receiving port into which a document to be scanned is introduced and a document discharging port from which the scanned document is discharged are formed, a document transferring path provided in the main body, and a scan unit to read information recorded on the document, wherein the document transferring path comprises:

a scan path including a first scan path formed at one end thereof with the document receiving port and a second scan path formed at one end thereof with the document discharging port;

a two-sided document branch path to branch from the second scan path to extend to a two-sided document outlet formed between the document receiving port and the document discharging port;

a two-sided document transferring path to guide the document reversed on the two-sided document branch path to the first scan path; and a first path converting apparatus provided in the two-sided document branch path at a region where the two-sided document branch path meets the two-sided document transferring path, wherein the two-sided document branch path includes a first portion between the scan path and the two-sided document transferring path, and a second portion between the two-sided document transferring path and a two-sided document outlet to an outside of the main body, and the first path converting apparatus is rotatable about a hinge and weighted to maintain open a document travel path between the two-sided document branch path and the two-sided document transferring path and to rotate upward when a document presses against a surface of the first path converting apparatus to allow the document to pass from the first portion of the two-sided document branch path to the second portion of the two-sided document branch path.

9. The image forming apparatus of claim 8, further comprising:

a two-sided document guide provided in the main body to guide the document discharged from the two-sided document outlet.

10. The image forming apparatus of claim 8, wherein the second scan path comprises first and second sub-paths positioned upstream and downstream of a point at which the two-sided document branch path branches from the second scan path, and the image forming apparatus includes a first path converting unit to to selectively connect the first sub-path to one of the second sub-path and the two-sided document branch path.

11. The image forming apparatus of claim 8, further comprising:

a document discharging unit including a loading surface inclined downward in a direction through which the document is discharged.

12. The image forming apparatus of claim 8, further comprising:

a roller provided between the two-sided document branch path and the second scan path to transfer the document passing through the two-sided document branch path and to discharge the document passing through the second scan path.

13. An image reading apparatus comprising:

a main body having a document receiving port, a document discharging port, and a two-sided document outlet disposed between the document receiving port and the document discharging port;

a scan unit disposed between a first scan path connected to the document receiving port and a second scan path connected to the document discharging port to read information of a document passing from the first scan path to the second scan path;

a two-sided document branch path connected between the second scan path and the two-sided document outlet to receive the document from the second scan path and to feed back the document toward the first scan path through the two-sided document outlet;

a two-sided document transferring path to guide the document reversed on the two-sided document branch path to the first scan path; and a first path converting apparatus provided in the two-sided document branch path at a region where the two-sided document branch path meets the two-sided document transferring path, wherein the two-sided document branch path includes a first portion between the scan path and the two-sided document transferring path, and a second portion between the two-sided document transferring path and the two-sided document outlet to an outside of the main body, and the first path converting apparatus is rotatable about a hinge and weighted to maintain open a document travel path between the two-sided document branch path and the two-sided document transferring path and to rotate upward when a document presses against a surface of the first path converting apparatus to allow the document to pass from the first portion of the two-sided document branch path to the second portion of the two-sided document branch path.

14. The image reading apparatus of claim 13, wherein:

the main body comprises a side disposed in a vertical direction; and the document receiving port, a document discharging port, and a two-sided document outlet are disposed on the side of the main body.

15. The image reading apparatus of claim 13, wherein:

the first scan path receives the document from an outside of the main body through the document receiving port in a first direction;

the second scan path discharges the document to the outside of the main body through the document discharging port in a second direction; and the two-sided document branch path exposes the document received from the second scan path to the outside of the main body through the two-sided document outlet in a third direction and feeds back to the first scan path.

16. The image reading apparatus of claim 15, wherein at least two of the first direction, the second direction, and the third direction are a same direction, and one of the first direction, the second direction, and the third direction is a different direction from the same direction.

17. The image reading apparatus of claim 15, wherein:

the main body comprises a side disposed in a vertical direction; and the first direction, the second direction, and the third direction have a first angle, a second angle, and a third angle with respect to the vertical direction, respectively.

18. An image forming apparatus comprising:

a printing unit to print an image on a printing medium; and a cover to cover a surface of the printing unit, the cover comprising:

an image reading unit having a main body having a document receiving port;

a document discharging port;

a two-sided document outlet disposed between the document receiving port and the document discharging port;

a scan unit disposed between a first scan path connected to the document receiving port and a second scan path connected to the document discharging port to read information of a document passing from the first scan path to the second scan path;

a two-sided document branch path connected between the second scan path and the two-sided document outlet to receive the document from the second scan path and to feed back the document toward the first scan path through the two-sided document outlet, so as to provide the image to the printing unit;

a two-sided document transferring path to guide the document reversed on the two-sided document branch path to the first scan path; and a first path converting apparatus provided in the two-sided document branch path at a region where the two-sided document branch path meets the two-sided document transferring path, wherein the two-sided document branch path includes a first portion between the scan path and the two-sided document transferring path, and a second portion between the two-sided document transferring path and the two-sided document outlet to an outside of the main body, and the first path converting apparatus is rotatable about a hinge and weighted to maintain open a document travel path between the two-sided document branch path and the two-sided document transferring path and to rotate upward when a document presses against a surface of the first path converting apparatus to allow the document to pass from the first portion of the two-sided document branch path to the second portion of the two-sided document branch path.

* * * * *